US005544824A

United States Patent [19]

Inoki

[11] Patent Number: 5,544,824

[45] Date of Patent: Aug. 13, 1996

[54] PULVERIZER

[75] Inventor: Masahiro Inoki, Kyoto, Japan

[73] Assignee: Hosokawa Micron Corporation, Osaka, Japan

[21] Appl. No.: 511,684

[22] Filed: Aug. 7, 1995

[30] Foreign Application Priority Data

Aug. 8, 1994 [JP] Japan ..... 6-185649

[51] Int. Cl.[6] ..... B02C 13/14

[52] U.S. Cl. ..... 241/80; 241/188.1

[58] Field of Search ..... 241/80, 97, 79.1, 241/191, 189.1, 188.1, 195

[56] References Cited

U.S. PATENT DOCUMENTS

| | | | |
|---|---|---|---|
| 1,697,704 | 1/1929 | Wood . | |
| 4,550,879 | 11/1989 | Tanaka et al. | 241/80 X |
| 5,195,695 | 3/1993 | Ondush et al. | 241/188.1 X |

FOREIGN PATENT DOCUMENTS

| | | | |
|---|---|---|---|
| 122608 | 10/1984 | European Pat. Off. . | |
| 2096047 | 2/1972 | France . | |
| 2028454 | 12/1971 | Germany | 241/80 |
| 893252 | 12/1981 | U.S.S.R. | 241/188.1 |
| 1281300 | 1/1987 | U.S.S.R. | 241/80 |

*Primary Examiner*—Mark Rosenbaum
*Attorney, Agent, or Firm*—Willian Brinks Hofer Gilson & Lione

[57] ABSTRACT

A pulverizer is provided with: a ring-form rotary hammer supported by a rotary shaft and having a pulverizing blade including a plurality of concaves and convexes on its outer surface; a liner fixed so that a gap is left between the rotary hammer and the liner and having a plurality of concaves and convexes on its surface which faces the hammer; and a rotary classifying fan for discharging toward an exit a material pulverized between the rotary hammer and the liner into a predetermined particle diameter or smaller and directed to an upper part. The pulverizing blade is provided substantially on an entire periphery, and a circulation passage for directing downward a material not discharged toward the exit is provided below the pulverizing blade.

4 Claims, 14 Drawing Sheets

FIG. 13
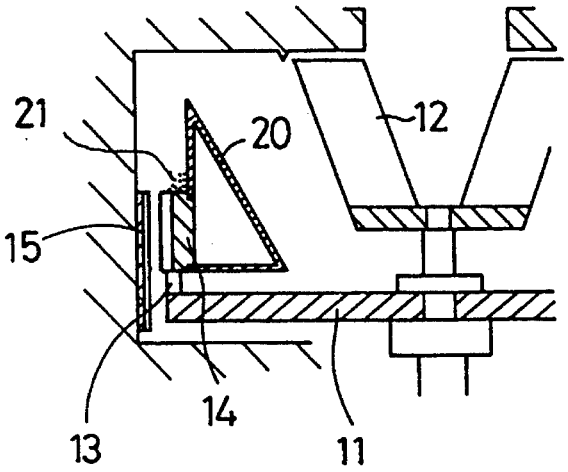
FIG. 14A
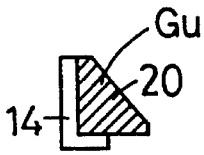
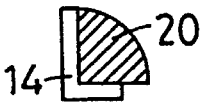
FIG. 14D
FIG. 14B
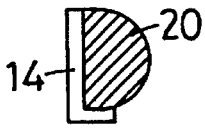
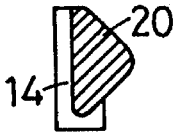
FIG. 14E
FIG. 14C
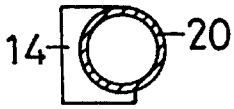

PULVERIZER

BACKGROUND OF THE INVENTION

1. Field of the Invention

The present invention relates to a pulverizer which performs, for example, micron-order pulverization, and more particularly to a pulverizer having a classifying mechanism incorporating a pulverization zone and a classification zone.

2. Description of the Prior Art

Referring to FIG. 1, there is shown a conventional pulverizer of this type. A disk 82 is mounted to a first rotary shaft 80 attached in a frame 90. A rotary hammer 83 protruding upward is provided at a peripheral end of the disk 82. A liner 84 is mounted to the inner surface of the frame 90 so as to face the rotary hammer 83. Air admitted through a air supplying hole 91 provided at a lower part of the frame 90 goes upward as shown by the arrows. Materials are supplied into the frame 90 through a screw feeder 92.

Reference numeral 85 represents a guide ring. The outside space of the guide ring 85 serves as the pulverization zone for pulverizing materials and the inside thereof serves as the classification zone for classifying the pulverized materials according to the particle diameter and weight. In the classification zone, a classifying fan 86 attached to a second rotary shaft 81 is provided.

The material supplied by the screw feeder 92 is pulverized between the rotary hammer 83 and the liner 84. Then, it goes up in the pulverization zone together with the air and enters the classification zone at the upper end thereof. The material having entered the classification zone is classified into the one to be discharged to an exit 93 and the one to be dropped along the guide ring 85 to enter the pulverization zone again. The material pulverized into a predetermined diameter or smaller is discharged to the exit 93 and directed to a dust collector (not shown) through a passage connecting with the exit.

In the pulverizer thus arranged, the liner 84 has concaves and convexes on its inner surface as shown in FIGS. 2B and 3B in any prior art. However, the configuration of the hammer 83 is different. Specifically, in the prior art (Japanese Published Patent Application S50-21695) of FIGS. 2A and 2B, the hammer 83 is provided on the disk 82 with a gap and its surface which faces the liner 84 has neither concaves nor convexes.

In the prior art (Japanese Patent Application H5-259552) of FIGS. 3A and 3B, the hammer 83 has concaves and convexes on its outer surface. In the cases of FIGS. 2A and 2B and 3A and 3B, the material not discharged to the exit 93 by the classifying fan 86 passes between the hammer 83 and the hammer 83 to circulate.

As another prior art, the one (Japanese Published Patent Application S61-36463) shown in FIGS. 4A and 4B is known. In this prior art, the hammer 83 has concaves and convexes on its entire periphery. The hammer 83 and the liner 84 are formed to be longer in the vertical direction and the pulverization of the supplied material is performed by passing it through the pulverization zone once. Therefore, there is no circulation zone.

In the prior art of FIGS. 2A and 2B, the pulverizing capability is weak since the hammer 83 has neither concaves nor convexes. For this reason, it takes a long time to pulverize the material into a predetermined particle diameter. In the prior art of FIGS. 3A and 3B, since the hammer 83 has a pulverizing tooth provided with concaves and convexes, the number of collisions between the material and the hammer 83 increases and the pulverizing power is improved accordingly. However, since the hammer 83 is not provided on the entire periphery, the improvement of the pulverizing power is limited and the pulverizing efficiency is not improved so much.

Since the prior art of FIGS. 4A and 4B has no idea of circulating the material to pulverize it and pulverizes the material only by passing it through the pulverizing zone once, to sufficiently increase the pulverizing power, it is necessary to form the hammer 83 and the liner 84 to be sufficiently long in the vertical direction, so that the rotational power (i.e. the torque of the motor) of the hammer 83 is remarkably high.

Furthermore, since the material which cannot be pulverized into a predetermined particle diameter or smaller is also discharged, the material which cannot be classified by the succeeding classifier is wasted or necessarily fed back to an entrance 91 of the pulverizer through another passage.

SUMMARY OF THE INVENTION

An object of the present invention is to provide a pulverizer in which the pulverizing power per one passage of the material through the pulverization zone is high and the material coming back from the classification zone to the pulverization zone is admitted in the gap between the hammer and the liner from the lower part to circulate.

To achieve the above-mentioned object, according to the present invention, a pulverizer is provided with: a ring-form rotary hammer supported by a rotary shaft and including a pulverizing blade which has a plurality of concaves and convexes on its outer surface; a liner fixed so that a gap is left between the rotary hammer and the liner and having a plurality of concaves and convexes on its surface which faces the hammer; and rotary-fan-type classifying means for discharging toward an exit a material pulverized between the rotary hammer and the liner into a predetermined particle diameter or smaller and directed to an upper part. The pulverizing blade is provided substantially on an entire periphery. A circulation passage for directing downward a material not discharged toward the exit is provided below the pulverizing blade.

In this case, a guide ring serving as a conveying guide for a material conveyed from an upper part of the gap to the circulation passage may be provided at a back of the pulverizing blade integrally with the rotary hammer.

Further, a plurality of ribbed plates are provided integrally with the rotary hammer below the pulverizing blade substantially in a radiant direction so as to form the circulation passage and the plates are arranged on a disk attached to the rotary shaft.

In that case, the convexes of the pulverizing blade is extended to form the plates so that the plates have a pulverizing function.

According to such features of the present invention, since a comparatively narrow gap between the ring-form rotary hammer (including the plates) and the liner is provided along the entire periphery, the material has extremely many chances to collide while passing through the gap because of the plurality of concaves and convexes of the rotary hammer and liner and the pulverizing capability per one passage of the material through the pulverization zone increases. The material not pulverized into a desired particle diameter is not discharged toward the exit by the classifying means but is directed to a lower part, and is directed to the gap between the hammer and liner through the circulation passage provided below the pulverizing blade from the lower part to be sufficiently re-pulverized into the desired particle diameter.

By forming the guide ring at the back of the hammer integrally therewith, the setting arrangement of the guide ring is simplified. In addition, the circulation passage is shortened. By providing a plurality of ribbed plates below the pulverizing blades integrally with the hammers to use the gap between the plates as the circulate passage, the formation of the hammer and circulation passage is facilitated. By extending the convexes of the pulverizing blade downward to form the plates so that the plates have a pulverizing function, the pulverizing efficiency further improves.

BRIEF DESCRIPTION OF THE DRAWINGS

This and other objects and features of this invention will become clear from the following description, taken in conjunction with the preferred embodiments with reference to the accompanied drawings in which:

FIG. 13 shows the attachment condition of the rotary hammer and a guide ring used in the present invention;

FIGS. 14A to 14E show various embodiments where the rotary hammer and guide ring used in the present invention are formed integrally with each other;

DESCRIPTION OF THE PREFERRED EMBODIMENTS

Figure 5:
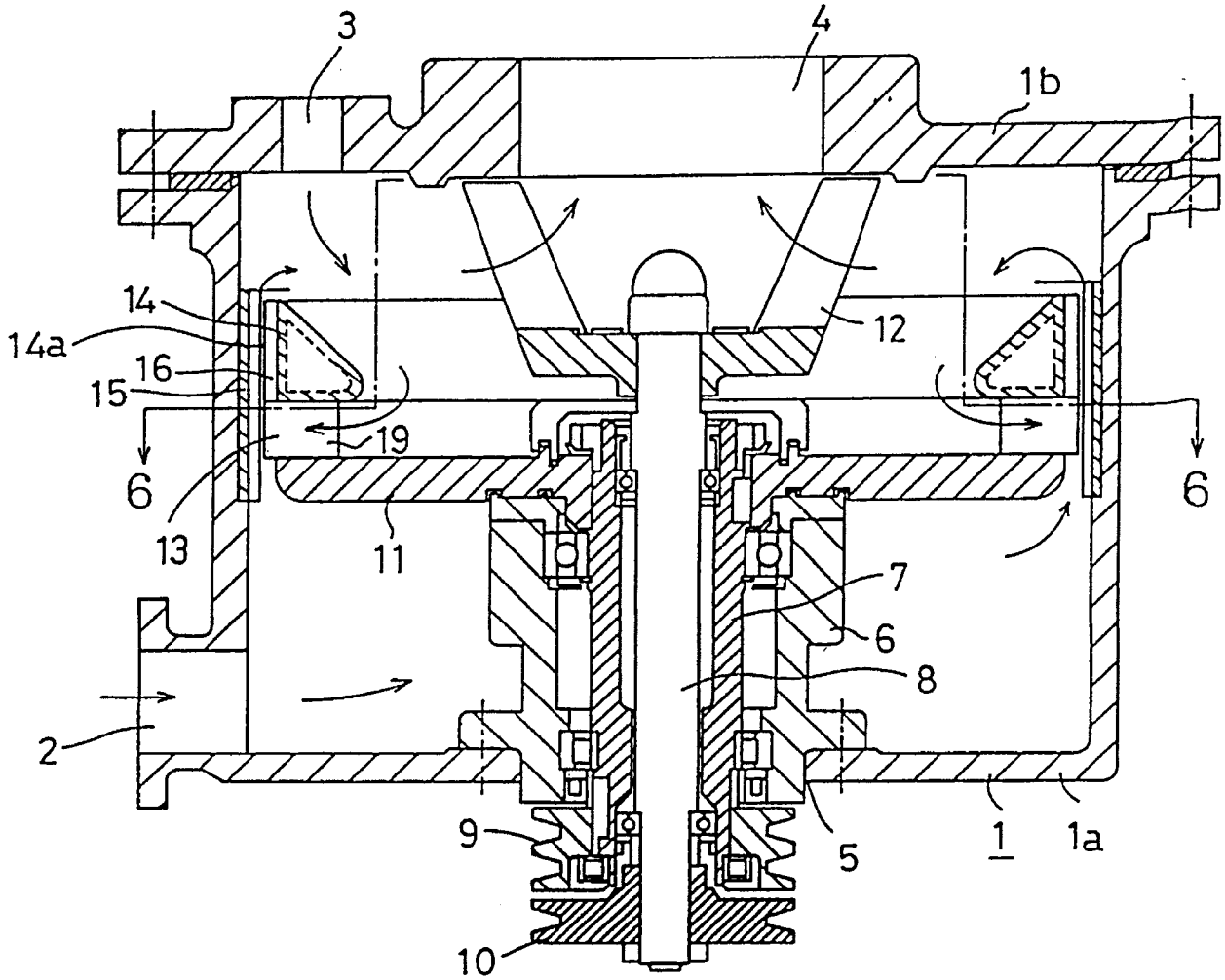
FIG. 5 is a cross-sectional view of a pulverizer embodying the present invention.
Figure 6:
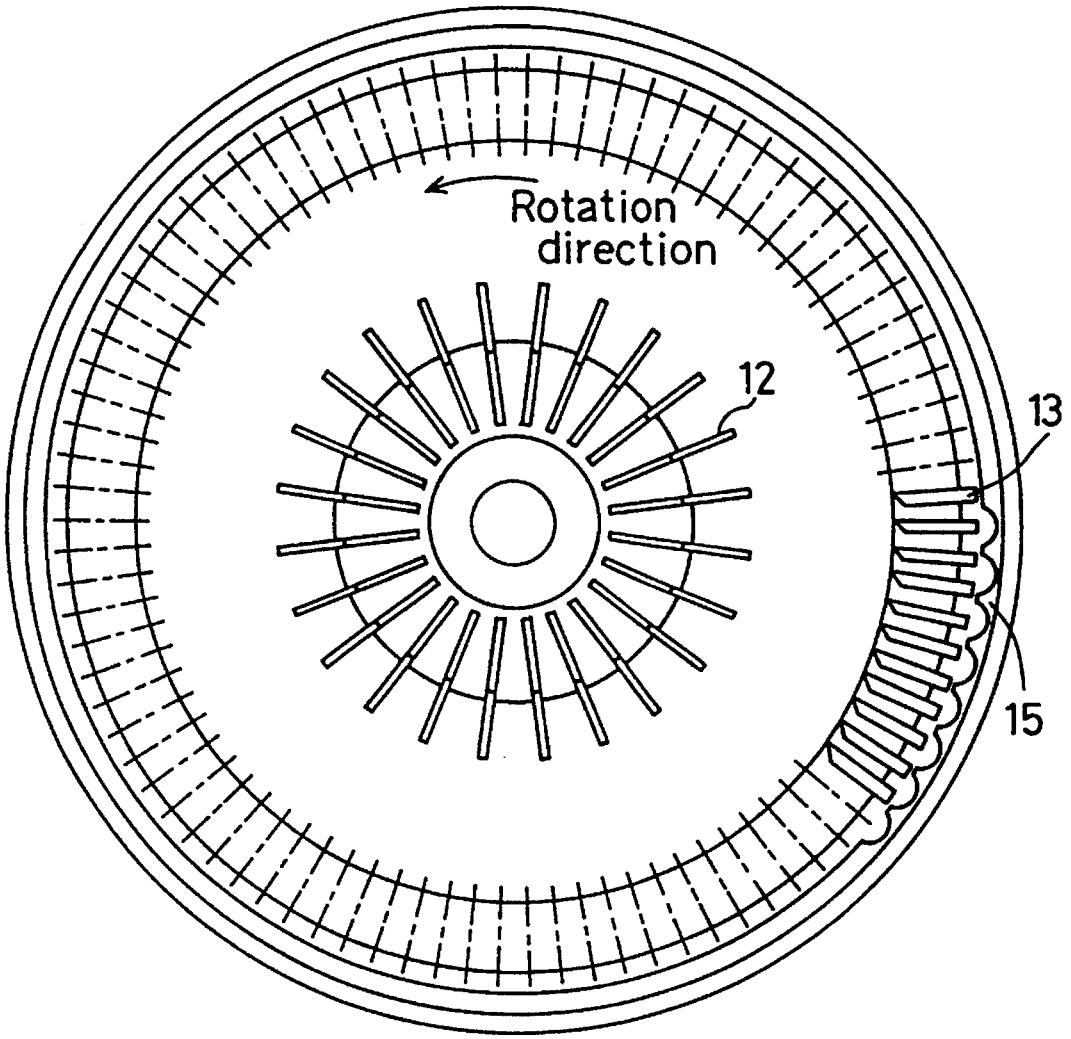
FIG. 6 is a cross-sectional view taken on line 6—6 of FIG. 5.

Referring to FIGS. 5 and 6, reference numeral 1 represents a frame constituting the outer hull of the pulverizer and having an air admitting hole 2, a material admitting hole 3 and an exit 4 for discharging pulverized materials. The frame 1 includes a body 1*a* and a cover 1*b*. The material admitting hole 3 and the exit 4 are provided to the cover 1*b*.

The air admitting hole 2 is provided at a lower part of the side surface of the body 1*a*. In the center of the undersurface of the body 1*a*, a hole 5 is formed for attaching rotary shafts. In the hole 5, a first rotary shaft 7 and a second rotary shaft 8 located inside the first rotary shaft 7 are mounted through a bearing 6.

Pulleys 9 and 10 for receiving the rotational power are provided at the lower ends of the first and second rotary shafts 7 and 8. A disk 11 is mounted at the other end of the first rotary shaft 7, and a classifying fan 12 is mounted to the other end of the second rotary shaft 8. A ribbed plate 13 is fixed on the disk 11 along its circumference. On the plate 13, a hammer 14 having a pulverizing blade 16 provided with concaves and convexes on its entire periphery is formed integrally with the plate 13. A liner 15 is provided on the inner surface of the frame 1 to face the hammer 14 having the plate 13.

Figure 7:
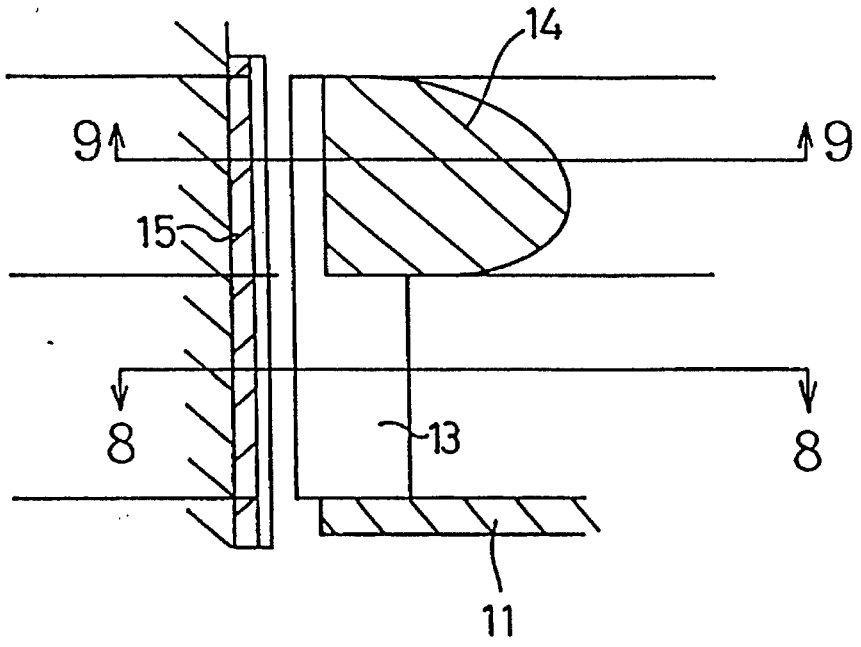
FIG. 7 is an enlarged view of a relevant portion of FIG. 5.
Figure 8:
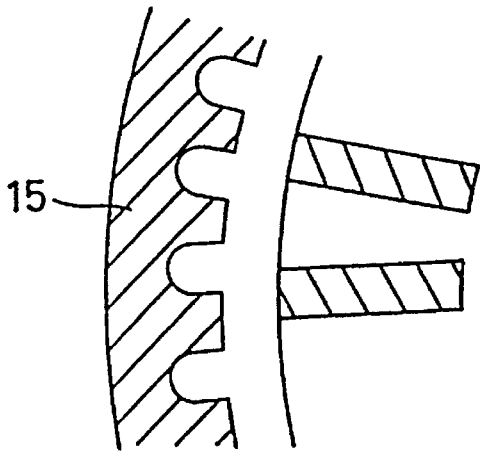
FIG. 8 is a cross-sectional view taken on line 8—8 of FIG. 7.
Figure 9:
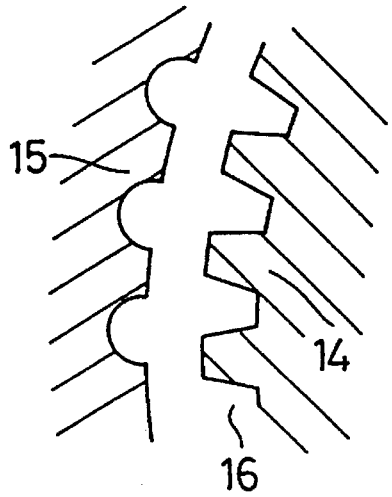
FIG. 9 is a cross-sectional view taken on line 9—9 of FIG. 7.
Figure 10:
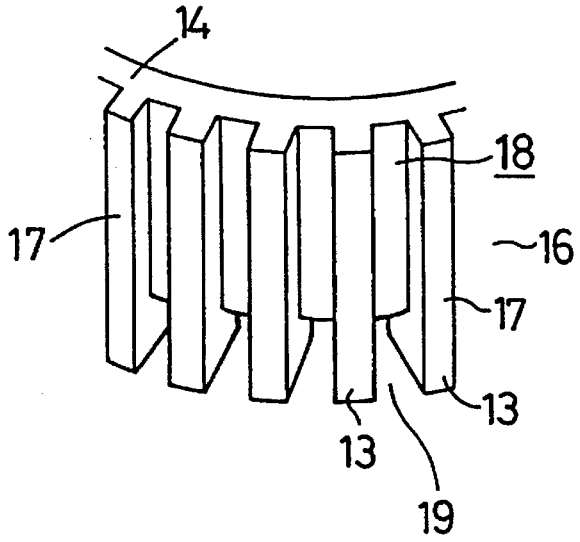
FIG. 10 is a perspective view of a part of a rotary hammer of FIG. 5.

FIG. 7 is an enlarged view of the hammer 14 having the plate and the liner 15. FIG. 8 is a cross-sectional view taken on line 8—8 of FIG. 7. FIG. 9 is a cross-sectional view taken on line 9—9 of FIG. 7. FIG. 10 is a perspective view of a part of the hammer 14 having the plate. As shown in FIGS. 8 and 9, the liner 15 has concaves and convexes. The hammer 14 has the pulverizing blade 16 formed by the concaves and convexes as shown in FIG. 9. As shown in FIG. 10, convexes 17 extend downward further than concaves 18 to constitute a part of the plate 13.

The configurations of the concaves and convexes are not necessarily the same from the top to the bottom. The configurations may be different between in the upper part and in the lower part. Various combinations of configurations may be considered as described later. For example, square (or triangular) grooves in the upper part and semicircular grooves in the lower part may be combined.

Between the adjoining plates 13 on the disk 11, a passage 19 is formed. The passage 19 serves as a circulation passage for returning the material which was pulverized but cannot pass the classifying fan to the gap between the hammer 14 and the liner 15.

Figure 11:
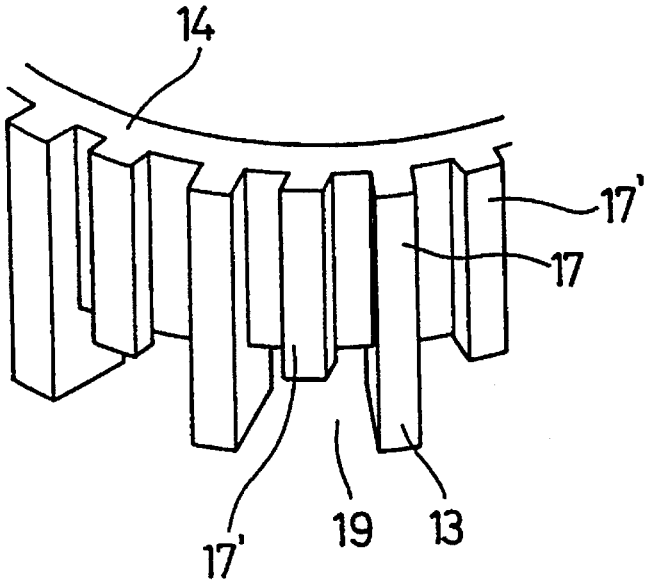
FIG. 11 is a perspective view showing another embodiment of the rotary hammer.

FIG. 11 shows another example of the hammer 14 having the plate. In this example, the convexes 17 are smaller every other convex. The smaller convexes 17' do not serve as the plate 13 and accordingly, the passage 19 is large compared to the arrangement of FIG. 10. With the arrangement of FIG. 11, the circulation of the material is smoother. However, with respect to the processing of the hammer 14, the arrangement of FIG. 10 is advantageous.

Figure 12:
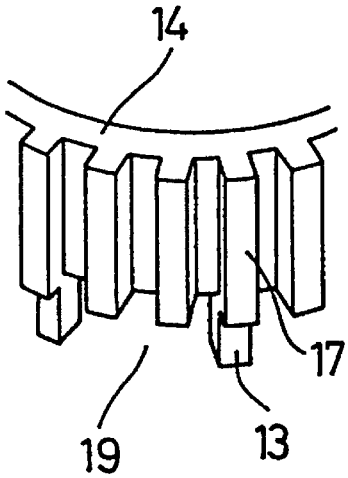
FIG. 12 is a perspective view showing still another embodiment of the rotary hammer.

In the embodiment of FIG. 12, the plate 13 is deleted every two convexes. In addition, in this embodiment, the plate 13 is retreated inward from the surfaces of the convexes 17 of the pulverizing blade 16. That is, since the material located on the lower side is coarser than that located on the upper side, the clearance between the plate 13 and the liner 15 is made large.

Figure 16:
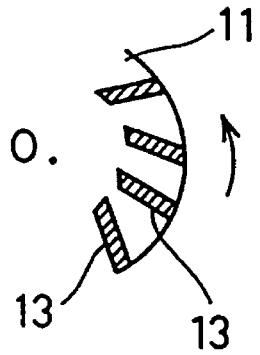
FIG. 16 shows the arrangement of plates to form a circulation passage in the present invention.

In the embodiments of FIGS. 10 to 12, the plate 13 has both a function as a fan to circulate the material and a function to pulverize the material. In order to reinforce the pulverizing function, the plate 13 preferably protrudes outside the disk 11. The inner angle of the plate 13 may be rounded off so that the material passes more easily. Alternately, the plate 13 may be arranged as shown in FIG. 16. With this arrangement, the material can be sent outside smoothly. In this case, the plates 13 on the disk 11 do not point toward the center O and the working surface (hatched surface) of each plate 13 is retreated with respect to the rotation direction shown by the arrow so that the portion closer to the circumference of the disk 11 is more retreated. With this arrangement, the material more easily moves from the inside (classification zone) to the outside (pulverization zone).

In the prior arts of FIGS. 2A and 2B and 3A and 3B, the pulverization zone and the classification zone are separated and the guide ring serving as the guide to circulate the material is provided independently of the hammer and a separating fan. For this reason, the circulation passage lengthens because of the guide ring. In view of this, the guide ring is provided integrally with the rotary hammer 14 in this invention.

Specifically, as shown in FIG. 13, a guide ring 20 is attached at the back of the hammer 14. Since the material readily adheres to the portion designated by the reference numeral 21, as shown in FIG. 14, the guide ring 20 is inclined to an extent such that the material does not adhere to the portion to remain there, and is formed to be substantially as high as the hammer 14. FIGS. 14A and 14B show variations of the guide ring 20. While the hatched portions show the guide rings 20 in these figures, if the guide ring 20 is hollow, the weight is reduced, so that the driving power of the motor is reduced.

Figure 15:
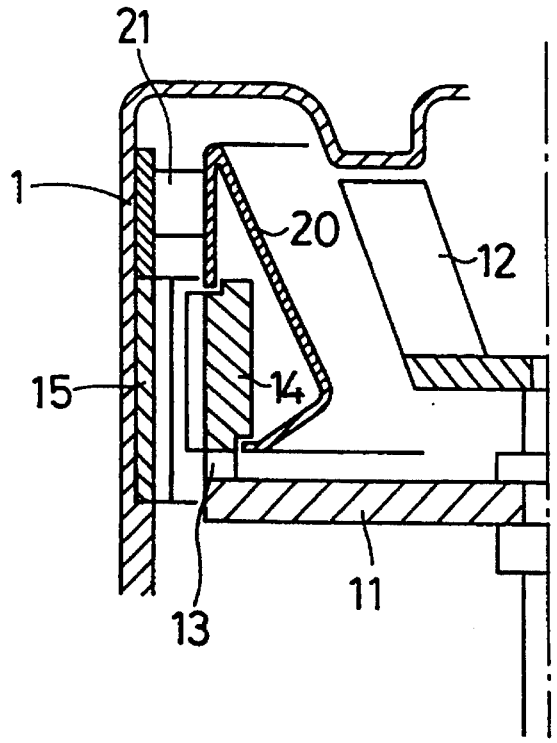
FIG. 15 shows an embodiment of the present invention where the rotary hammer and the guide ring are separated from each other.
Figure 17:
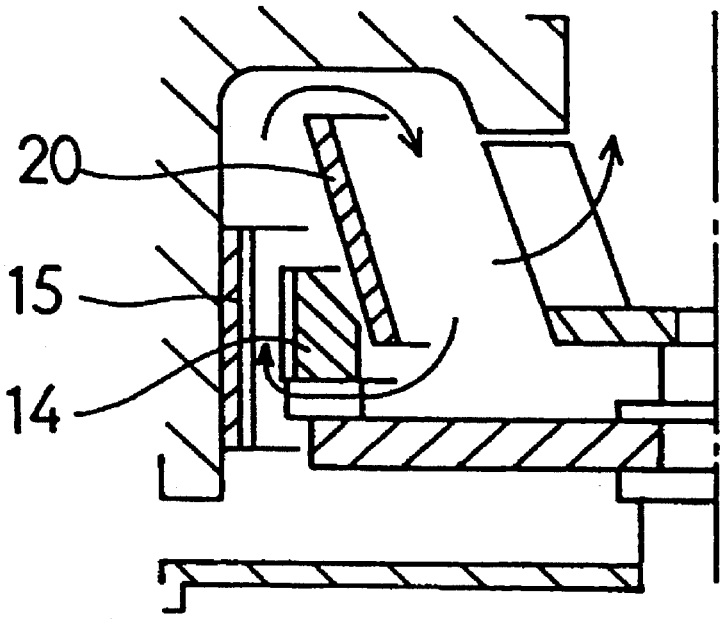
FIG. 17 shows another form of the rotary hammer and guide ring used in the present invention.
Figure 18:
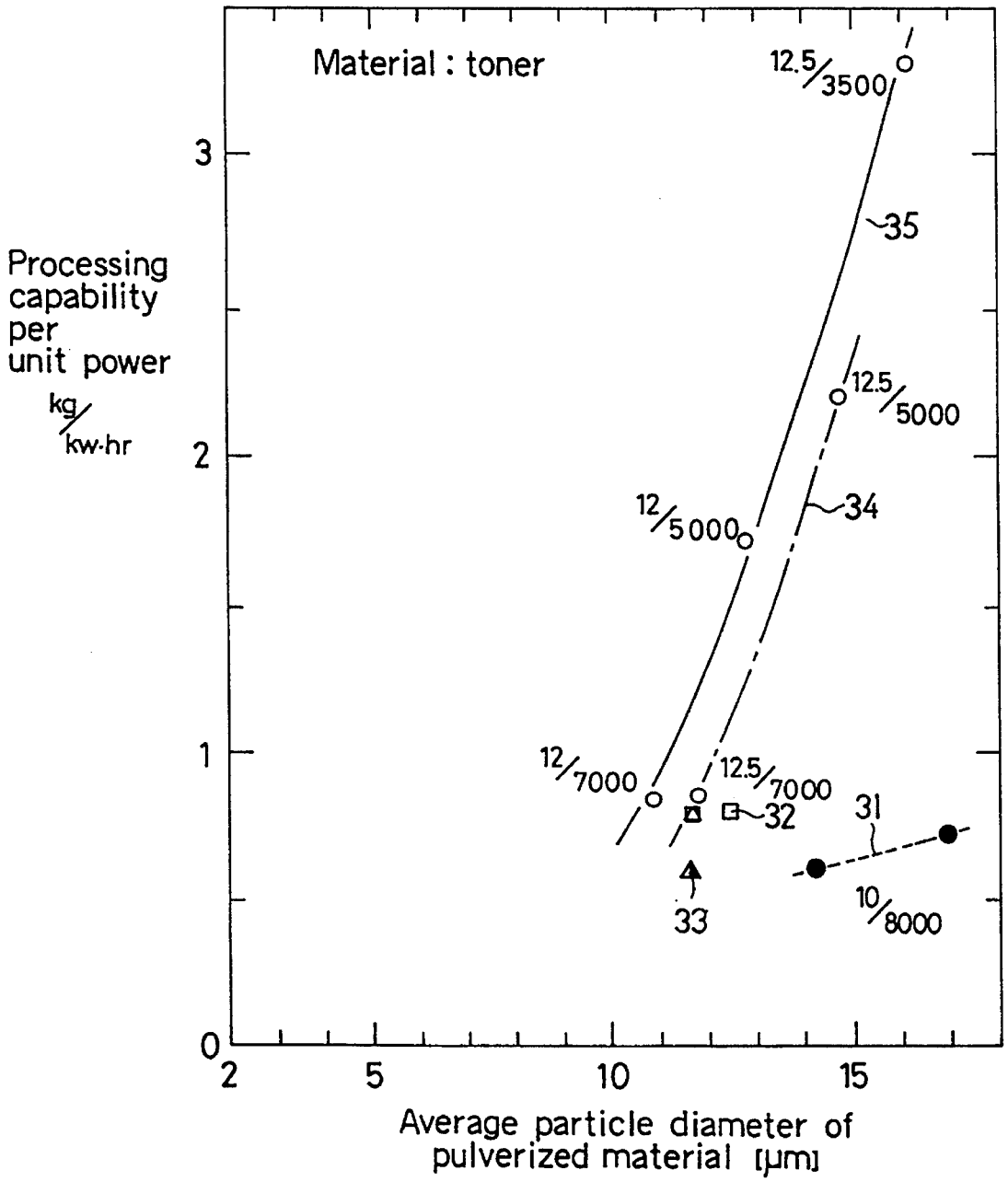
FIG. 18 is a characteristic view showing advantages of the present embodiment obtained when toner is used as the material.

FIG. 15 shows an embodiment in which the guide ring 20 is fixed to the frame 1 through a holding member 21. The hammer 14 and the guide ring 20 are arranged close to each other but not in contact with each other. As shown in FIG. 17, a guide ring similar to that of the guide ring of the prior art (FIGS. 2A and 2B and 3A and 3B) may be used.

While the structure of the embodiment of the present invention was described in the above, the gap between the liner 15 and the rotary hammer 14 is appropriately set according to the kind of the material and the particle diameter of the product. While a case where the hammer 14 has the concaves and convexes on its entire periphery was described as an example, the concaves and convexes may be absent at some places. That is, unlike FIG. 3, the concaves and convexes of the hammer 14 are necessarily present only substantially on the entire periphery.

The hammer 14 and the ring 13 may be formed to be detachable separately from each other so that they can be replaced easily and inexpensively when worn away. Further, if the hammer 14 is formed not to have a straight periphery but to be of a frustum or a trapezoid enlarged or reduced toward the top, and the inner surface of the liner 15 is formed to be inclined along the inclined surface of the hammer 14, the gap between the hammer 14 and the liner 15 can be arbitrarily adjusted by moving the whole of the hammer 14 vertically.

While the material admitting hole 3 is provided at the top in FIG. 5, a screw feeder may be provided at a lower part of the side surface of the body la to supply the material from the side. Alternately, the material may be supplied through the air admitting hole together with air.

Figure 20:
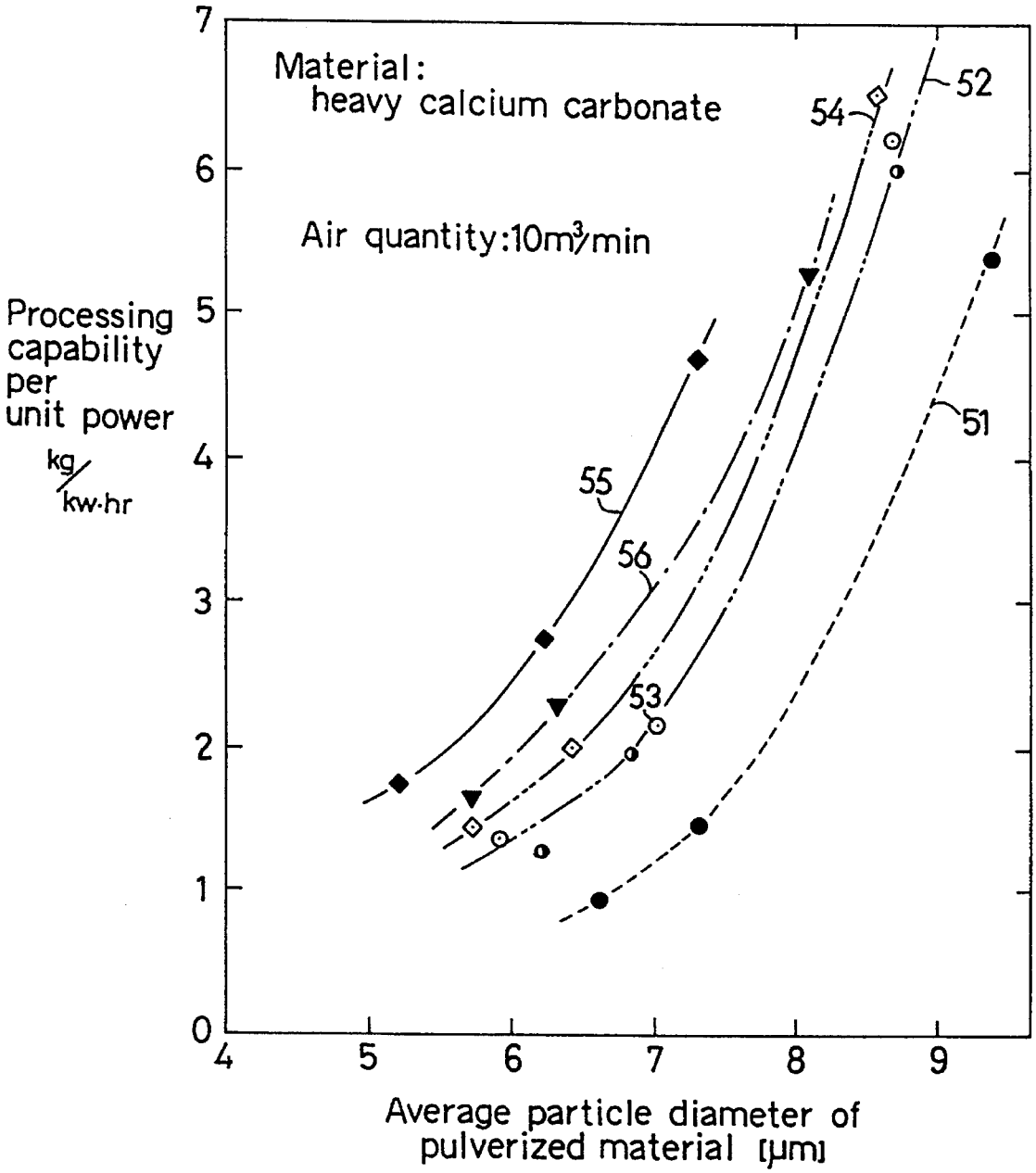
FIG. 20 is a characteristic view showing advantages of the present embodiment obtained when heavy calcium carbonate is used as the material.

Referring to FIG. 20 showing, in comparison with the prior art, an advantage of a pulverizer of the present invention obtained when toner with an average particle diameter D=250 μm is pulverized as the material, the axis of abscissas represents the average particle diameter of the pulverized material and the axis of ordinates represents the processing capability per unit power [kg/kw·hr]. Reference numeral 31 represents a characteristic of a pulverizer corresponding to the prior art of FIGS. 4A and 4B obtained when a hammer having longitudinal grooves is rotated at 6800 rpm. According to this characteristic, a pulverized material with an average particle diameter of only 14 to 17 μm is obtained and the pulverizing capability is as low as 0.6 to 0.7 kg/kw·hr.

Figure 1:
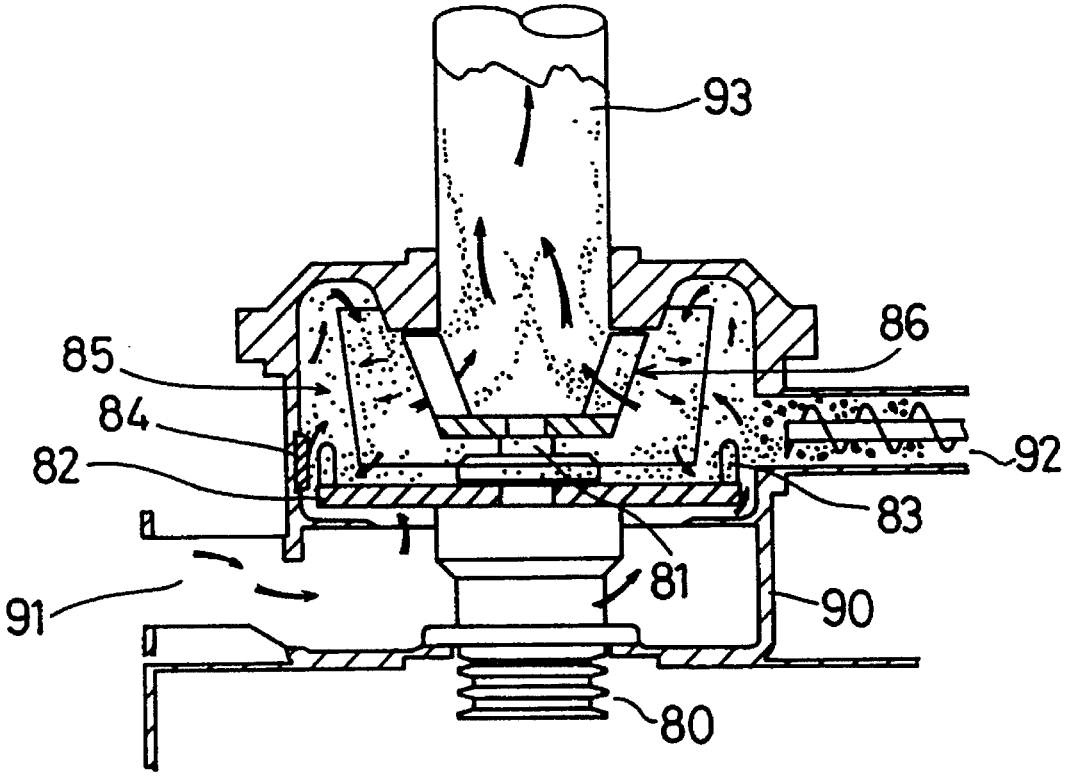
FIG. 1 PRIOR ART
FIG. 1 shows the general arrangement of the conventional pulverizer.
Figure 2A:
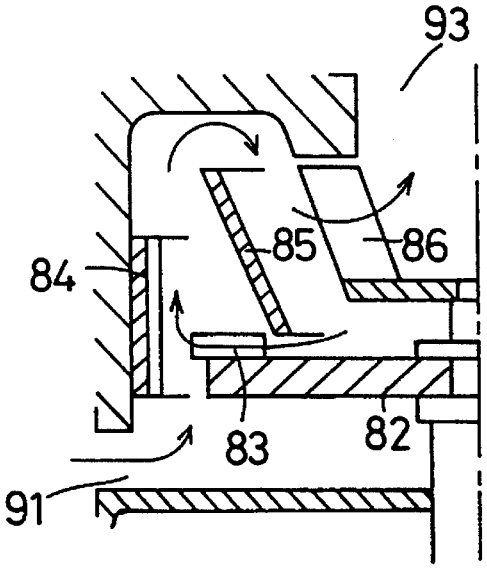
FIG. 2 A PRIOR ART
FIGS. 2A and 2B shows the arrangement of a relevant portion of a conventional pulverizer.
Figure 2B:
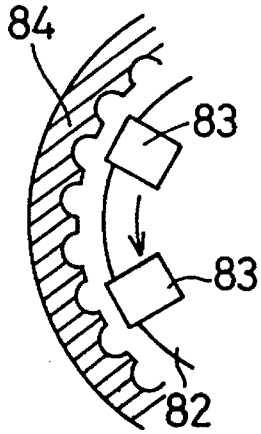
FIG. 2 B PRIOR ART
Figure 3A:
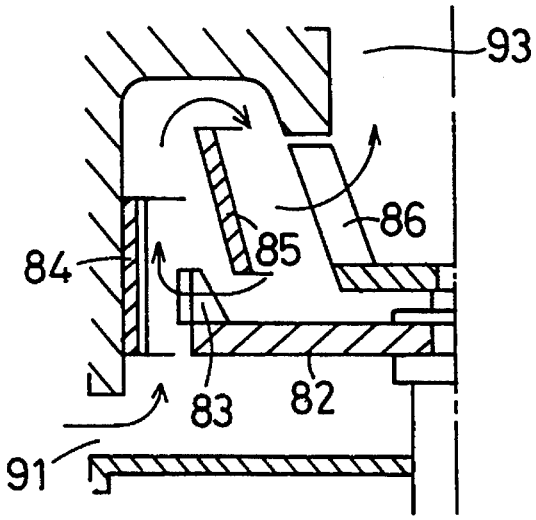
FIG. 3 A PRIOR ART
FIGS. 3A and 3B show the arrangement of a relevant portion of another conventional pulverizer.
Figure 3B:
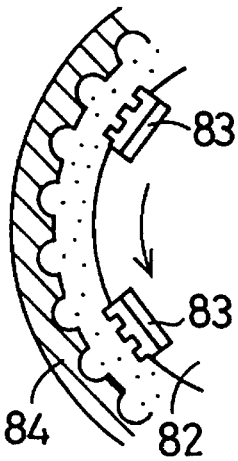
FIG. 3 B PRIOR ART
Figure 4A:
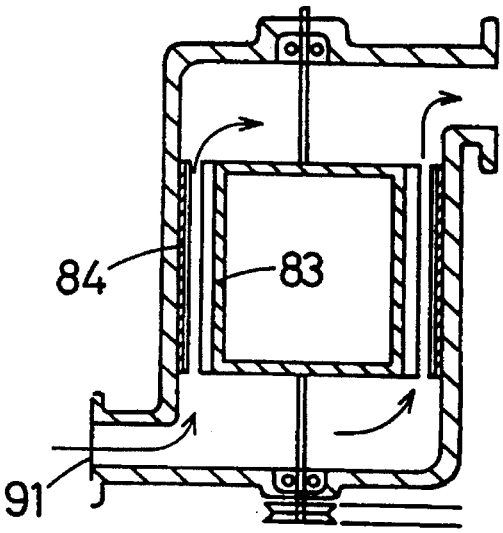
FIG. 4 A PRIOR ART
FIGS. 4A and 4B show the arrangement of a relevant portion of still another conventional pulverizer.
Figure 4B:
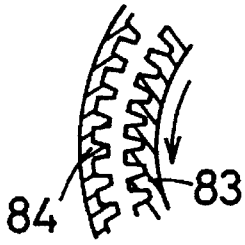
FIG. 4 B PRIOR ART

Reference numeral 32 represents a characteristic of a pulverizer corresponding to the prior art of FIGS. 4A and 4B obtained when the hammer is rotated at 12000 rpm. This pulverizer also has an inferior processing capability such as approximately 0.75 kg/kw·hr to obtain a particle diameter of 11.5 to 12.5 μm.

Reference numerals 33, 34 and 35 represent characteristics of the embodiments of the present invention. Reference numeral 34 represents a characteristic of the pulverizer of FIG. 5 obtained when the hammer is rotated at 6800 rpm relative to the liner having square grooves in the upper part and semicircular grooves in the lower part. Reference numeral 35 represents a characteristic of the same pulverizer obtained when the hammer is rotated at 8000 rpm. The characteristic 33 is the one obtained when a guide ring similar to that of the prior art is used (see FIG. 17). According to the embodiments of the present invention, when the unit power is substantially the same as that of the prior art, the material is pulverized into a smaller particle diameter, and to obtain a particle diameter substantially the same as that of the prior art, the processing capability per unit power is high.

Figure 19:
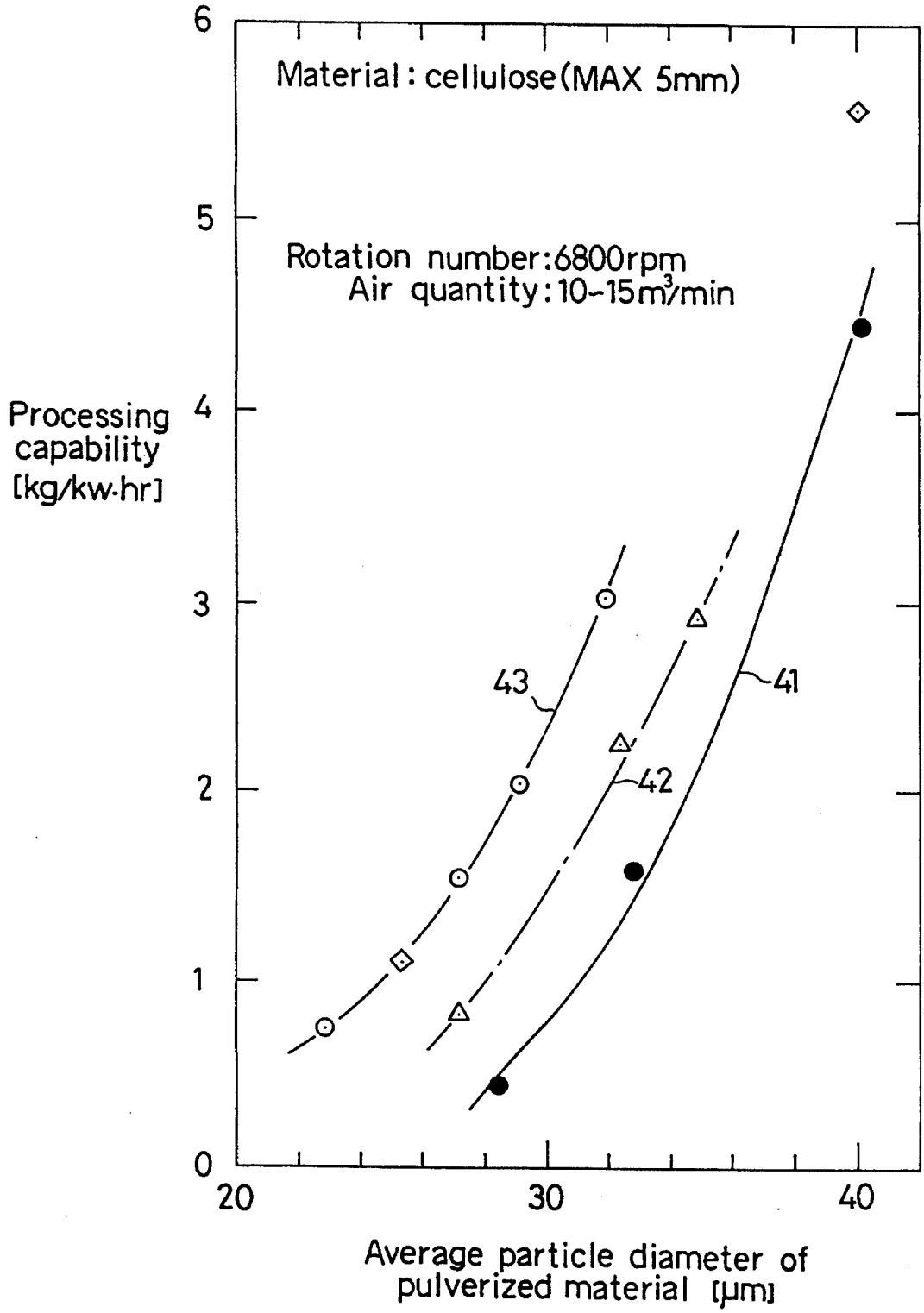
FIG. 19 is a characteristic view showing advantages of the present embodiment obtained when cellulose is used as the material.

Referring to FIG. 19, there are shown characteristics obtained when cellulose with a maximum particle diameter of 5 mm is pulverized as the material. Reference numeral 41 represents a characteristic of the prior art of FIG. 2. Reference numeral 42 represents a characteristic of the prior art of FIGS. 3A and 3B. Reference numeral 43 represents a characteristic of the embodiment of the present invention. The characteristics are all obtained when the hammer is rotated at 6800 rpm and the air quantity is 10 to 15 $m^3$/min. Thus, it is apparent that with the pulverizer of the present invention, the particle diameter of the pulverized material is smaller than that of the prior art and the processing capability is high also when the material is cellulose.

Referring lastly to FIG. 20, there are shown characteristics obtained when heavy calcium carbonate with an average particle diameter D=27 μm is pulverized as the material. Reference numeral 51 represents a characteristic of the prior art of FIGS. 3A and 3B. Reference numeral 52 represents a characteristic obtained when a guide ring similar to that of the prior art is used in the embodiment of the present invention (see FIG. 17). Reference numerals 53 to 56 represent characteristics of the embodiment of the present invention shown in FIG. 5.

The rotation number of the hammer is 6800 rpm with respect to the characteristics 52 to 54. The liner 2 has square grooves in the upper part and semicircular grooves in the lower part with respect to the characteristics 52, 53 and 56, and has triangular grooves in the upper part and semicircular grooves in the lower part with respect to the characteristics 54 and 55. The characteristics 52 to 56 of the embodiment of the present invention is superior to that of the prior art also in FIG. 20.

As described above, according to the present invention, since the rotary hammer and the pulverizing blade are present substantially on the entire periphery, the pulverizing capability per one pulverization is high, and since the material not pulverized into a desired particle diameter is directed to the gap between the hammer and the liner through the circulation passage provided below the pulverizing blade to be sufficiently re-pulverized, the material is readily pulverized into the desired particle diameter. Thus, in the present invention, the pulverizing efficiency is excellent as a whole.

By forming the guide ring at the back of the hammer 14 integrally therewith, the setting arrangement of the guide ring is simplified. In addition, the circulation passage is shortened. By providing a plurality of ribbed plates below the pulverizing blades integrally with the hammer to use the gap between the plates as the circulate passage, the formation of the hammers and circulation passage is facilitated. By extending the convexes of the pulverizing blade downward to form the plates so that the plates have a pulverizing function, the pulverizing efficient further improves.

Obviously, many modifications and variations of the present invention are possible in light of the above teachings. It is therefore to be understood that within the scope of the appended claims, the invention may be practiced other than as specifically described.

What is claimed is:

1. A pulverizer comprising:

a ring-form rotary hammer supported by a rotary shaft and including a pulverizing blade which has a plurality of concaves and convexes on its outer surface;

a liner fixed so that a gap is left between the rotary hammer and the liner and having a plurality of concaves and convexes on its surface which faces the hammer; and rotary-fan-type classifying means for discharging toward an exit a material pulverized between the rotary hammer and the liner into a predetermined particle diameter or smaller and directed to an upper part, wherein said pulverizing blade is provided substantially on an entire periphery, and wherein a circulation passage for directing downward a material not discharged toward the exit is provided below the pulverizing blade.

2. A pulverizer according to claim 1, wherein a guide ring serving as a conveying guide for a material conveyed from an upper part of the gap to the circulation passage is provided at a back of the pulverizing blade integrally with the rotary hammer.

3. A pulverizer according to claim 1, wherein a plurality of ribbed plates are provided integrally with the rotary hammer below the pulverizing blade substantially in a radiant direction so as to form the circulation passage, and wherein said plates are arranged on a disk attached to the rotary shaft.

4. A pulverizer according to claim 3, wherein said convexes of the pulverizing blade are extended to form the plate so that the plates have a pulverizing function.

* * * * *

UNITED STATES PATENT AND TRADEMARK OFFICE

CERTIFICATE OF CORRECTION

PATENT NO. : 5,544,824

DATED : August 13, 1996

INVENTOR(S) : Masahiro Inoki

It is certified that error appears in the above-identified patent and that said Letters Patent is hereby corrected as shown below:

In col. 8, line 29 (Claim 4, line 2), change "plate" to --plates--.

Signed and Sealed this

Fifth Day of November, 1996

*Attest:*

*Attesting Officer*

BRUCE LEHMAN

*Commissioner of Patents and Trademarks*